US006214782B1

(12) United States Patent
Chiou et al.

(10) Patent No.: US 6,214,782 B1
(45) Date of Patent: Apr. 10, 2001

(54) CATIONIC NITRILES FOR PROVIDING A SILVER TARNISH BENEFIT IN MACHINE DISHWASHING DETERGENT APPLICATIONS

(75) Inventors: Catherine Chiou, Saddle Brook; Narish Dhirajlal Ghatlia, Rutherford, both of NJ (US)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/534,895

(22) Filed: Mar. 24, 2000

(51) Int. Cl.[7] ..... C11D 3/395; C11D 1/62

(52) U.S. Cl. ..... 510/220; 510/286; 510/314; 510/312; 510/367; 510/372; 510/375; 510/514

(58) Field of Search ..... 510/220, 286, 510/314, 312, 367, 372, 375, 514

(56) References Cited

U.S. PATENT DOCUMENTS 5,888,419 * 3/1999 Caselia et al. ..... 252/186.39

* cited by examiner

*Primary Examiner*—Yogendra Gupta
*Assistant Examiner*—Charles Boyer

(57) ABSTRACT

Detergent formulations containing cationic nitriles are shown to exhibit reduced silver tarnishing as compared to similar formulations containing TAED.

9 Claims, No Drawings

CATIONIC NITRILES FOR PROVIDING A SILVER TARNISH BENEFIT IN MACHINE DISHWASHING DETERGENT APPLICATIONS

FIELD OF THE DISCLOSURE

The present disclosure relates to detergent compositions that contain bleaching compounds that reduce silver tarnishing.

BACKGROUND

Silver is chemically the most reactive element among the noble metals and tarnishes readily on exposure to sulfur bearing atmospheres. Discoloration, generally termed tarnishing, is caused by a silver oxidation process in which sulfide is formed. Food, such as onions, mustard and eggs that contain organic sulfur compounds, are also known to tarnish silver. See Singh et al., "Silver Tarnishing and its Prevention—A Review" Anti-corrosion Methods and Material, v. 30 (July 1983) pp. 4–8.

Bleaching compositions and bleach systems are well known and provide desired cleaning properties in many commercial detergents. Chlorine and N,N,N',N'-tetraacetyl ethylene diamine (TAED)/perborate, for example, are well known for their bleaching properties. Bleaching systems that include cationic nitriles in the presence of peroxide are also known (see, for example, U.S. Pat. Nos. 5,236,616 and 5,281,361, EP 0 303 520 B1 and WO 99/63038, the contents of which are incorporated herein by reference).

Silver tarnishing is also known to occur when an oxygen bleaching agent used in detergent compositions oxidizes the silver to silver oxide. This oxidation process causes surface blackening of the silverware when machine dishwashed.

Conventional detergents, particularly automatic machine dishwashing detergents, are generally formulated with chlorine bleaching agents in a high alkaline pH range. During washing, certain chlorine bleaches (e.g., chloroisocyanurate) react to form isocyanuric acid and thus not greatly effect silver discolorization.

Detergent compositions are, however, increasingly being based on peroxygen bleaching agents and are being formulated to be milder to produce environmentally friendly products. The problem of tarnishing of silver and silver plated articles has thus become more severe.

Therefore, there is a need for detergent compositions that have bleaching compositions yet have minimal detrimental effects on silverware. There is also a need for more cost-efficient detergent formulations, wherein the desired benefits are achieved through decreased quantities of raw material, through the use of less expensive ingredients and/or more efficient compatibility of materials.

SUMMARY

The present disclosure relates to the unexpected finding that detergent formulations containing cationic nitriles reduce the amount of silver tarnishing as compared to otherwise identical formulations containing TAED, instead of cationic nitriles, at a level that matches the stain removal performance of the nitrile containing formulations.

DETAILED DESCRIPTION

The present disclosure primarily relates to detergent formulations that are suitable for use in machine dishwashers. The formulations disclosed herein can be powder, tablet, block, gel, liquid, solid or semi-solid.

Suitable formulations generally include one or more of the following ingredients: both phosphate and nonphosphate (e.g. sodium citrate) builders; pH buffering agents; silicates; bleaches and bleaching systems including bleach catalysts; surfactants; enzymes; enzyme stabilization systems; thickeners; stabilizers and/or co-structures; fillers; defoamers; soil suspending agents; anti-redeposition agents; anti-corrosion agents; ingredients to enhance decor care; anti-tarnish agents; rinse aids; colorants; perfumes; and other known functional additives. More specific examples of the above and other known machine dish detergent ingredients are disclosed, for example, in U.S. Pat. Nos. 5,695,575, 5,705,465, 5,902,781, 5,904,161 and 6,020,294, the contents of which are incorporated herein by reference.

In general, the present disclosure relates to the use of cationic nitriles to reduce the occurrence of silver tarnish. The examples, below, show cleaning and silverware care benefits of such formulations as compared to other known enzyme/bleach compositions.

Suitable phosphate and non-phosphate formulations in accordance with the present disclosure include the following:

TABLE A

Formulation Ranges

| Component | Wt % |
|---|---|
| Sodium Carbonate | 0–50 |
| Sodium Bicarbonate | 0–30 |
| Sodium Disilicate | 0–40 |
| Sodium Citrate | 0–70 |
| Sodium Tripolyphospahte | 0–70 |
| Sodium Perborate or percarbonate | 2–25 |
| Bleach Activator/Catalyst | 0.05–5 |
| Anti-tarnishing agent | 0–2 |
| Polymer | 0–10 |
| Anti-scalant | 0–5 |
| Amylase | 0–10 |
| Protease | 0–5 |
| Nonionic Surfactant | 0–5 |
| Perfume | 0–0.5 |
| Sodium Sulfate | Balance |

In all examples, the following base formulation (no bleach precursor) was used:

TABLE B

Base Formulation

| Component | Wt % |
|---|---|
| Sodium Carbonate | 18.6 |
| Sodium Disilicate | 9.5 |
| Sodium Citrate | 17.3 |
| Sodium Perborate | 6.5 |
| Anti-tarnishing agent | 0.05 |
| Polymer | 2.6 |
| Anti-scalant | 0.7 |
| Amylase | 1.1 |
| Protease | 1.8 |
| Sodium Sulfate | Balance |

Suitable cationic nitriles include those disclosed in EP 0 303 520 B1. The preferred cationic nitrile, and that which was used in the examples is of the following formula:

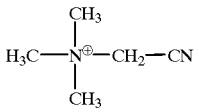

The preferred anion is $CH_3OSO_3^-$, however any suitable anion can be used.

More generally, suitable cationic nitrile compounds include the following:

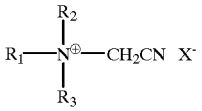

in which $R_1$ is an unsubstituted C1 to C24 alkyl or alkenyl, $R_2$ and $R_3$ are each independently a C1 to C3 alkyl, hydroxyalkyl having 1 to 3 carbon atoms, $—(C_2H_4O)_n H$, n being 1 to 6, $—CH_2CN$; or at least two of $R_1$, $R_2$ or $R_3$ are joined to form a heterocycle with the inclusion of the quaternary N atom and optionally additional heteroatoms, and $X^-$ is a suitable anion.

Example 1: Tea Stain Removal

Several dishwashing machine tests were carried out and results show that cationic nitrites are a more effective bleach precursor than TAED in terms of tea stain removal. In these tests, 30 g of base formulation (Table B) was used in each machine test. Bleach precursor (TAED or cationic nitrile) was then dosed separately at different levels to test the effectiveness of tea stain bleaching.

Machine test conditions were as follows: a Bauknecht GSF 4741 dishwasher set at the 50 Normal program. Water hardness was adjusted to 300 ppm of total hardness ($Ca^{+2}$:$Mg^{+2}$=4:1, expressed as $CaCO_3$) and 320 ppm of temporary hardness expressed as sodium bicarbonate (300/320 ppm water hardness). Soil load includes 40 g of ASTM standard food soil (a 4:1 wt/wt ratio of margarine/powdered milk) spread on the dishwasher door, 6 tea stained cups, 4 drinking glasses, 4 lipstick stained drinking glasses, 4 ceramic and 4 stainless steel plates with baked-on egg yolk soil, 4 wheat soiled, 4 custard soiled and 4 ceramic plates soiled by a composite soil (containing fat, protein and more than 50% of starch). Residual scores for tea stain are a 0 to 5 scale and 0 being completely cleaned.

As can be seen from Table 1 (below), cationic nitrites can be dosed at about ½ level of TAED to give an equal or better performance on tea stain removal.

TABLE 1

| Tea Stain Removal | | | |
|---|---|---|---|
| Bleach Precursor | Wt (g) | Wt %[a] | Residual tea score (0 to 5) |
| TAED | 0.67 | 2.23 | 0.4 |
| | 0.54 | 1.80 | 1.2 |
| | 0.47 | 1.57 | 3.2 |
| | 0.40 | 1.33 | 3.9 |
| Cationic Nitrile | 0.67 | 2.23 | 0 |
| | 0.54 | 1.80 | 0 |
| | 0.47 | 1.57 | 0 |
| | 0.40 | 1.33 | 0 |
| | 0.30 | 1.00 | 0.25 |

TABLE 1-continued

| Tea Stain Removal | | | |
|---|---|---|---|
| Bleach Precursor | Wt (g) | Wt %[a] | Residual tea score (0 to 5) |
| | 0.20 | 0.67 | 0.83 |
| | 0.10 | 0.33 | 4.0 |

[a]wt % indicates weight percentage of bleach precursor in the detergent composition.

Example 2: Effect of Bleach Precursor on build-up of Silverware Tarnishing

Nine-run build-up machine tests are summarized in Table 2 below. Both TAED and cationic nitrile caused tarnishing on silver plated spoons. However, TAED gives higher tarnish score (i.e. more tarnished) than cationic nitrites.

TABLE 2

| Effect of bleach precursor on silverware tarnishing[a] | | |
|---|---|---|
| | Bleach Precursor | |
| Run Number | Cationic Nitrite | TAED |
| 1 | 0.5 | 1.0 |
| 2 | 1.0 | 1.5 |
| 3 | 1.5 | 2.0 |
| 4 | 2.0 | 2.5 |
| 5 | 2.0 | 2.5 |
| 6 | 2.5 | 3.0 |
| 7 | 2.5 | 3.0 |
| 8 | 2.5 | 3.25 |
| 9 | 3.25 | 3.75 |

[a]Tarnish scores are averages of 4 silver plated spoons, and are defined as follow: 0 = no tarnish, 1 = very slight yellow color, 2 = more intense yellow color, 3 = gold or brown on entire surface, 4 = darker gold or brown on entire surface, and 5 = purple to black color.

Example 2 - Experimental conditions were as follows: A Miele G656 dishwasher was set at the 55° Normal program. Water hardness was adjusted to contain less than 20 ppm of total hardness ($Ca^{+2}$:$Mg^{+2}$=4:1, expressed as $CaCO_3$). Soil load used in each machine test included 6 tea-stained cups, 6 drinking glasses, 4 lipstick-stained drinking glasses, 4 ceramic and 4 stainless steel plates soiled with baked-on egg yolk, 4 wheat soiled, 4 potato soiled ceramic plates, and 4 ceramic plates soiled by a composite soil (containing fat, protein and more than 50% of starch). In addition, 40 g of ASTM standard food soil (a 4:1 wt/wt ratio of margarine/powdered milk) was spread on the dishwasher door. Base formulation (Table B, dosed at 30 g per wash) was used, followed by addition of bleach precursor, cationic nitrile or TAED, dosed in each run at 1.1 wt % or 2.2 wt % level, respectively to match their tea stain removal performance. A set of 4 silver-plated spoons (Oneida "Seneca" dessert spoons) were used throughout this nine-run build-up test. Silver tarnish scores were determined by visual assessment in the end of each run.

All component percentages are based on weight, unless otherwise indicated. All numerical values are considered to be modified by the term "about" and should be given the broadest available range of equivalents when construing the claims.

Although the illustrative embodiments of the present disclosure have been described herein, it is to be understood that the disclosure not limited to those precise embodiments, and that various other changes and modifications may be affected therein by one skilled in the art without departing from the scope or spirit of the disclosure.

What is claimed is:

1. A detergent composition comprising:

a) from about 0.05 wt % to about 5 wt % of a cationic nitrile compound; and b) an effective amount of a peroxygen source; and wherein said composition provides silver tarnish performance that is better than the performance of an otherwise identical formulation that has no cationic nitrile compound and has TAED at a level to achieve the same tea stain removal performance achieved with an otherwise identical formulation containing cationic nitrile.

2. A detergent composition according to claim 1, wherein said cationic nitrile has the following formula

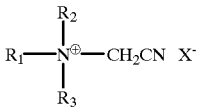

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and $X^-$ is a suitable anion.

3. A detergent composition according to claim 2, wherein $R_1$, $R_2$, and $R_3$ are each $CH_3$.

4. A detergent composition according to claim 2, wherein $X^-$ is $CH_3OSO_3^-$.

5. A detergent composition according to claim 1, wherein the formulation is a powder, tablet, block, gel, liquid, solid or semi-solid.

6. A method of reducing the occurrence of silver tarnish on silverware in a machine dishwasher comprising:

a) providing a detergent composition comprising a bleaching system consisting essentially of a peroxygen source and cationic nitrile compounds;

b) providing silverware;

c) creating a wash liquor with the detergent composition; and d) contacting the silverware with the wash liquor;

wherein the silverware exhibits less silver tarnish as compared to an otherwise identical process wherein TAED is substituted for the cationic nitrile and the TAED is dosed at a level to achieve the same tea stain removal performance achieved with an otherwise identical composition containing cationic nitrile.

7. The method according to claim 6, wherein said cationic nitrile has the following formula:

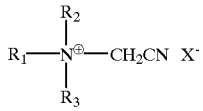

in which $R_1$ is an unsubstituted C1 to C24 alkyl or alkenyl, $R_2$ and $R_3$ are each independently a C1 to C3 alkyl, hydroxyalkyl having 1 to 3 carbon atoms, —$(C_2H_4O)_n$ H, n being 1 to 6, —$CH_2CN$; or at least two of $R_1$, $R_2$ or $R_3$ are joined to form a heterocycle with the inclusion of the quaternary N atom and $X^-$ is a suitable anion.

8. The method according to claim 7, wherein $R_1$, $R_2$, and $R_3$ are each $CH_3$.

9. The method according to claim 7, wherein $X^-$ is $CH_3OSO_3^-$.

* * * * *